United States Patent [19]

Ross

[11] Patent Number: 4,582,218

[45] Date of Patent: Apr. 15, 1986

[54] SAFETY MUG FOR LIQUIDS WHICH PERMITS THE LIQUID TO RETAIN ITS TEMPERATURE WHILE IT IS IN THE MUG AND FURTHER RETAIN THE LIQUID IF THE MUG IS TIPPED

[76] Inventor: Gary Ross, 4220-A Glencoe Ave., Marina Del Rey, Calif. 90292

[21] Appl. No.: 731,442

[22] Filed: May 6, 1985

[51] Int. Cl.[4] ..... B65D 41/06; B65D 41/26; B65D 47/04

[52] U.S. Cl. ..... 220/290; 215/307; 220/90.4; 220/293; 220/304; 220/366; 222/484; 222/554; 222/555

[58] Field of Search ..... 220/90.2, 90.4, 208, 220/366, 293, 303, 304, 290; 215/307, 311, 314, 355, 356; 222/484, 485, 563, 544, 547, 554, 555

[56] References Cited

U.S. PATENT DOCUMENTS

| | | | |
|---|---|---|---|
| 241,737 | 5/1881 | Skerry | 222/554 X |
| 634,742 | 10/1899 | Bayless | 215/356 X |
| 2,007,692 | 7/1935 | Reiter | 215/313 |
| 2,378,355 | 6/1945 | Cobel | 222/554 |
| 2,437,784 | 3/1948 | Laskin | 220/90.4 |
| 2,601,767 | 7/1952 | Wall | 220/90.4 |
| 3,140,799 | 7/1964 | Mehr | 222/484 X |
| 3,362,590 | 1/1968 | Martin | 222/548 |
| 4,303,173 | 12/1981 | Nergard | 220/90.4 X |

*Primary Examiner*—Allan N. Shoap
*Attorney, Agent, or Firm*—Thomas I. Rozsa

[57] ABSTRACT

The present invention relates to a container for liquid which is able to retain the liquid therein for drinking purposes at a temperature close to its original temperature for a period of time, will assure that the liquid will not spill out if the container is tipped, and facilitates easy drinking of the liquid from the container. The container further includes an interiorly recessed shelf possessing at least one gap within the shelf wall and which accommodates a sealing member or top which contains a protruding tongue which can be inserted through the gap and rotated below the shelf to fasten the sealing member in place. Then the top can function as a sealing member to retain the liquid in place and assure that the liquid will not spill if the container is accidentally tipped. The top will further serve to entirely seal the container to thereby retain the liquid therein at close to its original temperature for a period of time.

10 Claims, 7 Drawing Figures

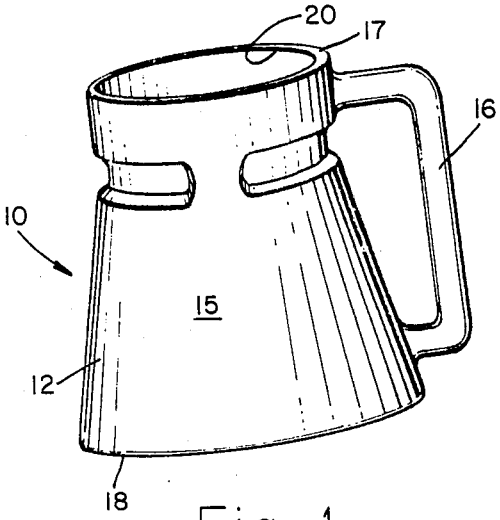
Fig. 1.
Fig. 2.
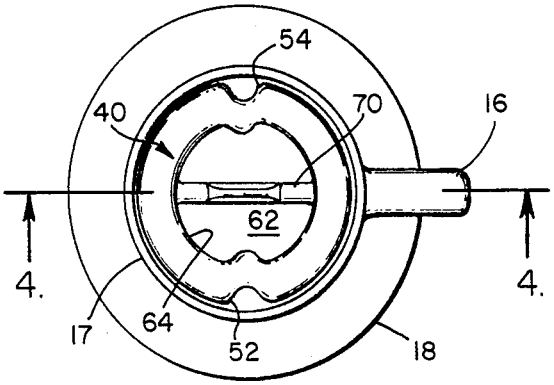
Fig. 3.
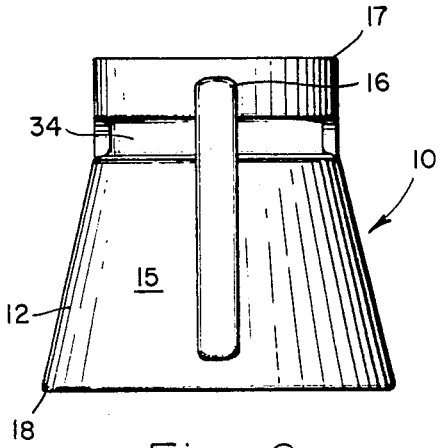
Fig. 4.
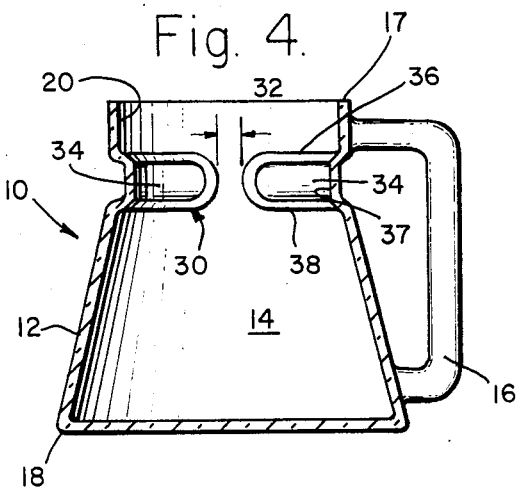
Fig. 6.
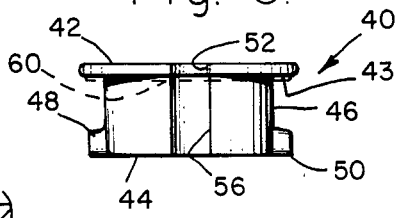
Fig. 5.
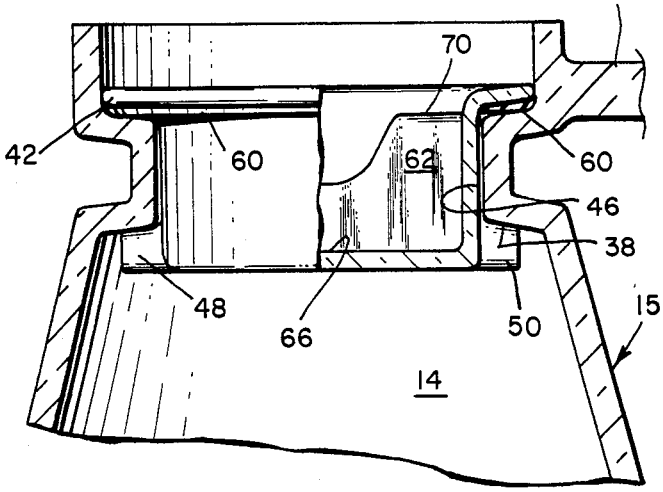
Fig. 7.
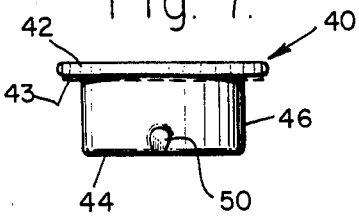

SAFETY MUG FOR LIQUIDS WHICH PERMITS THE LIQUID TO RETAIN ITS TEMPERATURE WHILE IT IS IN THE MUG AND FURTHER RETAIN THE LIQUID IF THE MUG IS TIPPED

BACKGROUND OF THE INVENTION

1. Field of the Invention

The present invention relates to containers for liquids which permit the liquid to remain hot or cold while it is retained in the container and further permit the user to drink the liquid from the container. The present invention further relates to removable sealing means on a container which assist in retaining the liquid in the container so that liquid will not spill out should the container accidentally be tipped over.

2. Concurrent Filing of Design Patent

Inventor Gary Ross has, concurrently with the filing of this application for a Utility Patent, filed an application in the United States Patent and Trademark Office for a Design Patent on one embodiment of the Temperature Retaining Safety Mug, seeking patent protection for the new, original and ornamental design of his invention, apart from the novel and nonobvious utility aspects of his invention.

3. Description of the Prior Art

In general, containers which keep a liquid contained therein at almost their original temperature for several hours are known in the prior art. These containers are called vacuum bottles and are comprised of two walls enclosing a vacuum chamber therebetween and fitted with a metal outer case. The vacuum bottle is completely sealed at its opening by means of a screw cap or cork. Liquid is conventionally dispensed from the vacuum bottle into a cup. While it is possible for one to drink directly from a vacuum bottle, it is not commonly done since the opening is not intended to function as a drinking lip and liquid can easily spill out during the drinking process.

Conventional glasses, cups and mugs are commonly used to hold liquids for drinking purposes. However, their tops are completely open. As a result, the liquid can be retained at its original temperature for only a short period of time. In addition, if the container should accidentally be tipped, the liquid contained therein will spill out.

Therefore, there is no presently known apparatus in the prior art which can retain a liquid for drinking purposes at a temperature close to its original temperature for a period of time, assure that the liquid will not spill out if the container is tipped, and facilitates easy drinking of the liquid from the container.

SUMMARY OF THE PRESENT INVENTION

The present invention relates to a container for liquid which is able to retain the liquid therein for drinking purposes at a temperature close to its original temperature for a period of time, will assure that the liquid will not spill out if the container is tipped, and facilitates easy drinking of the liquid from the container.

It has been discovered, according to the present invention, that if a container is designed with an interiorly recessed shelf possessing at least one gap within the shelf wall and which accommodates a sealing member or top which contains a protruding tongue which can be inserted through the gap and rotated below the shelf to fasten the sealing member in place, then the top can function as a sealing member to retain the liquid in place and assure that the liquid will not spill if the container is accidentally tipped. The top will further serve to entirely seal the container to thereby retain the liquid therein at close to its original temperature for a period of time.

It has also been discovered, according to the present invention, that if the sealing member or top contains a gap or opening in its outer perimeter such that the gap can be aligned with the gap in the shelf, then a user can drink liquid from the container by aligning the two gaps so that liquid can flow out. At the same time, most of the top remains sealed to facilitate retaining the liquid at near its original temperature for a period of time.

It has further been discovered, according to the present invention, that if the lower surface of the top is fitted with a sealing ring such as a flat rubber ring, then the top will not slide against the surface of the shelf to thereby retain the top in the position in which it has been set. Therefore, if a user wishes to completely seal the container, the gap in the top or sealing member needs to be rotated away from the gap in the shelf. If the user wishes to drink from the container, the gap in the top or sealing member needs to be rotated so that it is in alignment with the gap in the shelf. It will be appreciated that the sealing ring will also contain a gap which is aligned with the gap in the top or sealing member.

It has additionally been discovered, according to the present invention, that if the shelf and top members contain a pair of oppositely disposed gaps, the liquid will pour out of the container in a smoother fashion.

It has also been discovered, according to the present invention, that if the shelf is recessed into the container by a sufficient distance such that the top is also recessed into the container, the top is substantially stabilized and will not be easily knocked out of its position. In addition, if the handle portion of the top is recessed into a well in the top, the top can be more easily inserted into the container and rotated about the internal supporting shelf.

It is therefore an object of the present invention to provide a container for liquid which is able to retain the liquid therein for drinking purposes at a temperature close to its original temperature for a period of time, will assure that the liquid will not spill out if the container is tipped, and facilitates easy drinking of the liquid from the container.

It is another object of the present invention to provide a simple but effective design for an internal shelf to permit access so that the sealing member or top can be easily inserted into the container and further provide a design wherein most of the container will remain sealed while a small portion contains an aligned opening between the top and shelf to permit liquid to be drank from the container.

It is a further object of the present invention to provide an apparatus whereby the top may be rotated relative to the supporting shelf in the container and remain in its set position after it is rotated and further provide a design in the top to facilitate easy rotation of the top and to prevent the top from being accidentally knocked off the container.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation there is illustrated:

FIG. 1 is a perspective view of the present invention Temperature Retaining Safety Mug.

FIG. 2 is a top plan view of the present invention Temperature Retaining Safety Mug.

FIG. 3 is a rear elevational view of the present invention thermos mug.

FIG. 4 is a cross-sectional view taken along line 4—4 of FIG. 2.

FIG. 5 is an enlarged partial cross-sectional view of the present invention Temperature Retaining Safety Mug with the lid or top in place and rotated such that the key or tongue rests below the internal shelf.

FIG. 6 is a front elevational view of the top sealing member or lid.

FIG. 7 is a side elevational view of the top sealing member or lid.

DETAILED DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principals of the invention. Various changes and modifications which are obvious to one skilled in the art to which the invention pertains are deemed to be within the spirit, scope and contemplation of the invention as further defined in the appended claims.

A perspective view of the present invention Temperature Retaining Safety Mug 10 is shown in FIG. 1. The body portion 15 of the Temperature Retaining Safety Mug 10 comprises a side wall 12, an internal chamber 14, and a handle 16 attached to the side wall. In the embodiment shown in FIG. 1, the side wall of the lower portion of the Temperature Retaining Safety Mug 10 is generally in the shape of a frustum. This design serves to provide greater stability to the Temperature Retaining Safety Mug since the base 18 is wider that the upper portion of the Temperature Retaining Safety Mug 10. It is emphasized that other designs for the shape of the Temperature Retaining Safety Mug such as generally cylindrical are also within the spirit and scope of the present invention.

The present invention involves placing a recessed shelf 30 within the Temperature Retaining Safety Mug 10. The shelf 30 extends inwardly from the internal wall 20 of the mug 10 and extends for most of the circumference of internal wall 20. By way of example, if the thermos mug is approximately four and one quarter inches tall, the shelf can be recessed such that its top is approximately one-half inch from the top of mug 10. It will be appreciated that any other recessed distance is also within the spirit and scope of the present invention. The shelf 30 must contain at least one gap 32 as shown in the cross-sectional view of FIG. 4. By way of example only, the gap can be approximately one-half inch wide. It will be appreciated that the present invention encompasses any multiplicity of such gaps. In the preferred embodiment, the shelf will contain a pair of oppositely disposed gaps located one-hundred and eighty degrees apart. In the preferred embodiment, the body of the Temperature Retaining Safety Mug 10 is made of one piece construction with the shelf 30 molded as an integral part of the body. In the preferred embodiment, the side wall 12 of the Temperature Retaining Safety Mug 10 contains a groove or channel 34 at the location of the shelf 30. While it is not necessary for the location of the shelf to be visible from the side of the mug, this visibility adds an extra beneficial feature of facilitating easy visual location of how high the thermos mug 10 should be filled with liquid. In order to be properly sealed, the Temperature Retaining Safety Mug 10 should be filled to just below the level of the lower surface 38 of the shelf 30. In addition, the groove or channel 34 provides an additional means for lifting the thermos mug 10.

Another important portion of the present invention is the mating sealing member or lid 40 which fits within the Temperature Retaining Safety Mug 10 and is rotatably retained by the internal shelf 30. As shown in FIGS. 6 and 7, the sealing member or lid 40 is comprised of a top surface 42, a bottom surface 44, and a side wall 46. The lid 40 further comprises one or more keys or tongues which protrude from the side wall 46 at a location adjacent the bottom surface 44. The number of keys or tongues will match the number of gaps in the shelf 30. As previously mentioned, in the preferred embodiment the shelf will contain a pair of oppositely disposed gaps (one of which is shown as 34 in FIG. 4). In the preferred embodiment as shown in FIG. 6, the lid 40 contains a pair of oppositely disposed keys or tongues 48 and 50 extending radially outward from the side wall 46 and located adjacent bottom surface 44. The lid 40 also contains one or more openings or gaps on its upper surface 42 and along the circumference. The number of gaps in the upper surface circumference correspond to the number of gaps in the shelf. In the preferred embodiment, as best illustrated in FIG. 2, the lid 40 contains a pair of oppositely disposed gaps 52 and 54. As shown in FIG. 6, the upper surface 42 has a greater diameter than the side wall 46. The depth of each gap in the upper surface extends inwardly to a distance adjacent the side wall 46. To facilitate ease of liquid removal, the vertical area of the side wall 46 in alignment with a gap 52 or 54 contains a recess or channel. As shown in FIG. 6, channel 56 is in alignment with gap 52. In the preferred embodiment, each gap 52, 54 will be located at approximately ninety (90) degrees to a key or tongue 48 and 50. In this way, the key or tongue can be inserted through the gap(s) in the shelf and then the lid 40 is rotated by ninety degrees in order to align each gap 52 and 54 in the lid with a respective gap in the shelf. By having the key or tongue at ninety degrees to the opening, the maximum retaining force on the lid is achieved.

To assist in friction retention of the lid, a seal 60 can be placed directly below the upper surface 42 so that the seal 60 is aligned between the lower part 43 of the upper surface portion 42 of lid 40 and the upper surface 36 of shelf 30. By way of example, the seal 60 can be a flat piece of rubber which contains a central opening whose outer diameter is slightly larger than the outer diameter of side wall 46 on lid 40. The seal 60 must also contain a corresponding number of gaps in order to correspond with the gaps in the top surface 42 of lid 40.

Another improvement in the design of the lid is the handle member 70. The lid 40 contains a centrally disposed well or chamber 62 which extends from the upper surface 42 to adjacent the lower surface 44. The well or chamber 62 is hollow and is bounded by an internal side wall 64. A transverse handle member 70 is located within the chamber 62 and extends across the diameter of the chamber 62. It also runs from adjacent the top of the lid to the bottom 66 of the chamber. The recess handle member 70 is therefore protected within the chamber and further will not interfere with the drinking process. As an additional feature, the handle member 70 may contain a centrally disposed recess 72 to provide additional room so that the individual's nose will not hit the handle 70 while he is drinking from the Temperature Retaining Safety Mug 10.

The sealing member or lid 40 is shown inserted into the Temperature Retaining Safety Mug body 15 in FIG. 5. The lid 40 is inserted such that a respective key or tongue in the handle is inserted through a respective gap in the shelf. The top portion of the handle rests on the top surface of the shelf with the seal therebetween. The handle is then rotated such that a corresponding gap in the top surface of the lid coincides with a respective gap in the shelf. The keys or tongues (48 and 50) rest directly below and preferably in contact with the lower surface 38 of the shelf 30. The side wall 46 of lid 40 is adjacent the interior wall 37 of the shelf 30. The lid 40 is recessed within the body of the Temperature Retaining Safety Mug as shown in FIG. 5. As a result, the upper surface 17 of the body 15 of Temperature Retaining Safety Mug 10 acts as the lip to be used by the user while drinking.

Liquid is therefore securely retained within the lower portion of chamber 14. When no liquid is to be removed, the handle 70 can be rotated such that the gaps 52 and 54 in the lid are adjacent an upper portion 36 of shelf 30 so that the lower portion of chamber 14 is completely sealed. As a result, the lower chamber serves to retain the liquid at near its original temperature for at least twenty minutes. This is extremely useful when the liquid is hot coffee or a cold soda. When the user wishes to drink the liquid, the lid is rotated such that the gaps in the top surface of the lid are in alignment with the gaps in the shelf. Since this still results in only a small opening, the temperature of the liquid within is still maintained at close to its original temperature.

By way of example, the mug and lid can be made of porcelain or other ceramic material. Due to the tight fit of the lid, the Temperature Retaining Safety Mug can be jostled or tipped over without concern that the liquid therein will spill out.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the invention might be embodied or operated.

The invention has been described in considerable detail in order to comply with the patent laws by providing a full public disclosure of at least one of its forms. However, such detailed description is not intended in any way to limit the broad features or principals of the invention, or the scope of patent monopoly to be granted.

What is claimed is:

1. A mug comprising:

a. a body member;

b. said body member comprising a side wall, a handle attached thereto, and a hollow chamber therein bounded by an internal side wall;

c. a recessed shelf located in said internal side wall of said body member;

d. said shelf located at a fixed distance below the top of said mug and circumscribing most of the circumference of said internal side wall and being divided by a transverse gap;

e. a lid member;

f. said lid member comprising a bottom surface, a transverse side wall, and a top surface extending radially outward from the transverse side wall;

g. a key protruding radially outward from said transverse side wall and adjacent said bottom surface of said lid member;

h. a gap located in the circumference of said top surface of said lid and extending radially inwardly to a distance adjacent said transverse side wall;

i. a seal circumscribing said transverse side wall and located directly beneath said top surface of said lid and comprising a gap in its circumference aligned with the gap in said top surface of said lid;

j. a centrally disposed recessed chamber within said lid;

k. a transverse lid handle within said centrally disposed recessed chamber; and l. said lid being inserted into said body member of said mug by aligning said key with said gap in said shelf and placing said lid such that said seal rests on the top surface of said shelf and rotating said lid such that said key rests directly below the lower surface of said shelf;

m. whereby, the lower portion of said internal chamber beneath said shelf is entirely sealed when the gap in said lid is not aligned with a gap in said shelf and the contents in the lower chamber may be removed while the lid is in place when the gap in said lid is aligned with the gap in said shelf.

2. The invention as defined in claim 1 wherein said transverse side wall of said lid contains a groove aligned with said gap in said top surface.

3. The invention as defined in claim 1 wherein said mug is a container for liquids.

4. The invention as defined in claim 1 wherein said side wall of said mug contains a recessed area aligned with the recessed shelf in the internal side wall.

5. A mug comprising:

a. a body member;

b. said body member comprising a side wall, a handle attached thereto, and a hollow chamber therein bounded by an internal side wall;

c. a recessed shelf located in said internal side wall of said body member;

d. said shelf located at a fixed distance below the top of said mug and circumscribing most of the circumference of said internal side wall and being divided by a multiplicity of transverse gaps and spaced located around the shelf;

e. a lid member;

f. said lid member comprising a bottom surface, a transverse side wall, and a top surface extending radially outward from the transverse side wall;

g. a multiplicity of keys protruding radially outward from said transverse side wall, adjacent said bottom surface of said lid member, and in spaced locations around the circumference of said lid and separated by the same distances as the gaps in said shelf so that each key can be aligned with a corresponding gap in said shelf;

h. a multiplicity of gaps located in the circumference of said top surface of said lid, each gap extending radially inwardly to a distance adjacent said transverse side wall, each gap being offset from each key but located in spaced locations around said top surface at distances equal to the distances between said gaps in said shelf so that each gap is said lid can be aligned with a corresponding gap in said shelf;

i. a seal circumscribing said transverse side wall and located directly beneath said top surface of said lid and comprising a multiplicity of gaps in its circumference aligned with each gap in the seal aligned with a corresponding gap in said top surface of said lid;

j. a centrally disposed recessed chamber within said lid;

k. a transverse lid handle within said centrally disposed recessed chamber; and l. said lid being inserted into said body member of said mug by aligning each key with a corresponding gap in said shelf and placing said lid such that said seal rests on the top surface of said shelf and rotating said lid such that each key rests directly below the lower surface of said shelf;

m. whereby, the lower portion of said internal chamber beneath said shelf is entirely sealed when the gaps in said lid are not aligned with a gap in said shelf and the contents in the lower chamber may be removed while the lid is in place when the gaps in said lid are aligned with the gaps in said shelf.

6. The invention as defined in claim 5 wherein said shelf contains a pair of oppositely disposed gaps, said lid contains a pair of oppositely disposed keys, and the top surface of said lid containts a pair of oppositely disposed gaps.

7. The invention as defined in claim 6 wherein each of said keys is offset from each of said gaps in the lid by approximately ninety degrees.

8. The invention as defined in claim 5 wherein said transverse side wall of said lid contains a multiplicity of grooves with each groove being aligned with a respective gap in said lid.

9. The invention as defined in claim 5 wherein said mug is a container for liquids.

10. The invention as defined in claim 5 wherein said side wall of said mug contains a recessed area aligned with the recessed shelf in the internal side wall.

* * * * *